US008636405B2

(12) United States Patent
Cusin

(10) Patent No.: US 8,636,405 B2
(45) Date of Patent: Jan. 28, 2014

(54) SYSTEM FOR SECURING A PART WITHOUT DRIVING IN OR BONDING

(75) Inventor: Pierre Cusin, Villars-Burquin (CH)

(73) Assignee: Nivarox-FAR S.A., Le Locle (CH)

( * ) Notice: Subject to any disclaimer, the term of this patent is extended or adjusted under 35 U.S.C. 154(b) by 419 days.

(21) Appl. No.: 12/913,429

(22) Filed: Oct. 27, 2010

(65) Prior Publication Data

US 2011/0103200 A1 May 5, 2011

(30) Foreign Application Priority Data

Oct. 29, 2009 (EP) ..... 09174421

(51) Int. Cl.
*G04B 31/00* (2006.01)

(52) U.S. Cl.
USPC ..... 368/322; 368/325

(58) Field of Classification Search
USPC ..... 368/322–323, 324–325, 231–232; 29/525.09, 231–232
See application file for complete search history.

(56) References Cited

U.S. PATENT DOCUMENTS

| | | | | |
|---|---|---|---|---|
| 836,706 | A * | 11/1906 | Richards | 403/373 |
| 3,830,577 | A * | 8/1974 | Rampe et al. | 403/378 |
| 7,950,847 | B2 * | 5/2011 | Zaugg et al. | 368/175 |
| 8,210,740 | B2 * | 7/2012 | Verardo et al. | 368/322 |
| 8,277,117 | B2 * | 10/2012 | Verardo et al. | 368/321 |
| 2010/0061192 | A1 * | 3/2010 | Hessler et al. | 368/177 |

FOREIGN PATENT DOCUMENTS

| | | |
|---|---|---|
| CH | 40 228 | 6/1908 |
| CH | 508 914 | 12/1970 |
| CH | 1 411 400 | 4/2004 |
| CH | 698 677 | 9/2009 |
| EP | 2 104 007 | 9/2009 |

OTHER PUBLICATIONS

Unpublished Swiss patent application No. CH1549/09 filed Oct. 7, 2009.

European Search Report issued in corresponding application No. EP09174421, completed Mar. 2, 2010.

* cited by examiner

*Primary Examiner* — Sean Kayes
(74) *Attorney, Agent, or Firm* — Griffin & Szipl, P.C.

(57) ABSTRACT

The invention relates to a system (9) for securing a part (7) made of a material with no usable plastic domain, including a securing device (11) on an arbour (3) passing through a hole (8) in said part. According to the invention, the securing device (11) includes a recess (4) that communicates with the hole (8) in said part and securing means (6) attached to the arbour (3) and at least partially matching the shape of the recess (4), so as to make the movement of the part (7) integral with that of the arbour (3).

The invention concerns the field of timepiece manufacture.

16 Claims, 2 Drawing Sheets

SYSTEM FOR SECURING A PART WITHOUT DRIVING IN OR BONDING

This application claims priority from European Patent Application No. 09174421.9 filed Oct. 29, 2009, the entire disclosure of which is incorporated herein by reference.

FIELD OF THE INVENTION

The invention relates to a system for securing a part made of a material that has no usable plastic domain, i.e. which cannot be driven in and, more specifically, a part of this type formed of silicon-based material.

BACKGROUND OF THE INVENTION

It is known, in watchmaking, to mount parts on arbours by driving in said parts, i.e. via plastic deformation of the part and/or the arbour. The advent of parts made of silicon, makes it impossible to secure said parts by driving them onto arbours because of the risk of breakage thereof. In current fabrication systems, a polymer type adhesive material is used to secure the silicon parts to their arbours or another locking system involving a third mechanical part. However, these solutions are not satisfactory because, in the first solution, the adhesive materials age randomly and sometimes very prematurely and the second solution is too complex to implement.

SUMMARY OF THE INVENTION

It is an object of the present invention to overcome all or part of the aforementioned drawbacks by proposing a system for securing a part made of material with no usable plastic domain onto an arbour, which uses neither driving in nor bonding techniques.

The invention therefore relates to a system for securing a part made of material with no usable plastic domain, which includes a securing device on an arbour, said arbour passing through a hole in said part, characterized in that the securing device has a recess that communicates with the hole in said part and securing means attached to the arbour and at least partly matching the shape of the recess in order to make the movement of the part integral with that of the arbour, without driving in or bonding the part.

Advantageously, the part made of material with no usable plastic domain is not stressed in its plastic domain (no driving in) but simply moved mechanically by the assembly comprising the arbour and securing means.

According to other advantageous features of the invention:

the recess is blind to form a slot;

the recess has no edge;

the securing means has an insert made of metallic material;

the metallic insert is obtained by partially melting said arbour or by melting a solder or by shrink fitting said metallic material in amorphous form;

the securing device further includes a collar mounted on the arbour for use as a shoulder for said part;

the material that has no usable plastic domain is silicon-based.

The invention also relates to a timepiece, characterized in that it includes a securing system in accordance with any of the preceding variants.

Finally, the invention relates to a method of securing a part made of material with no usable plastic domain onto an arbour, characterized in that it includes the following steps:

a) fabricating the part with a hole for receiving said arbour and a recess that communicates with the hole;

b) fabricating said arbour;

c) assembling the arbour in the hole of the part;

d) filling the recess with a metallic material so that it matches the shape of the recess and part of the external diameter of said arbour;

e) hardening the metallic material to secure the part to the arbour without driving in or bonding.

According to other advantageous features of the invention:

step d) is achieved by localised melting of the arbour or by melting a solder using high energy radiation;

step d) is achieved by shrink fitting said metallic material in amorphous form;

step c) continues until the part abuts against a collar of the arbour formed during step b);

the material with no usable plastic domain is silicon-based.

BRIEF DESCRIPTION OF THE DRAWINGS

Other features and advantages will appear more clearly from the following description, given by way of non-limiting illustration, with reference to the annexed drawings, in which.

DETAILED DESCRIPTION OF PREFERRED EMBODIMENTS

Figure 1:
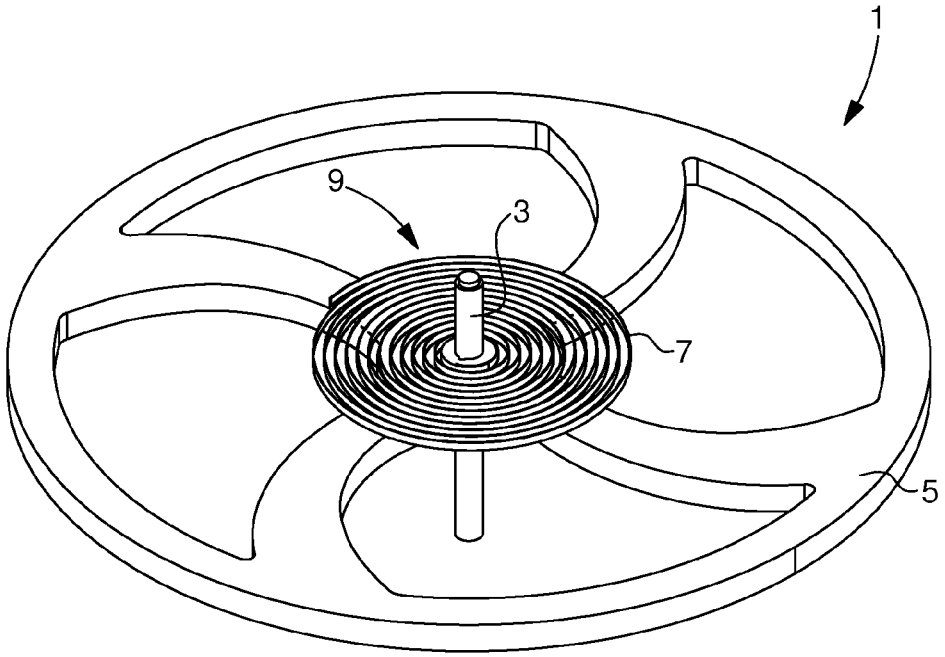
FIG. 1 is a diagram of a sprung balance resonator according to the invention.

In the example illustrated in FIG. 1, the invention will be explained with reference to a sprung balance resonator, generally referenced 1. However, the invention can also apply, for example, to a wheel set or to pallets within or outside the field of watchmaking.

Sprung balance resonator 1 has a pivoting arbour 3, a balance 5, a balance spring 7 and a securing system 9. Pivoting arbour 3, which may also be called the balance staff in the example of FIG. 1, is used for rotatably mounting balance 5 and balance spring 7 between two bearings, which are, for example, arranged respectively in a bridge and a plate (not shown).

Figure 2:
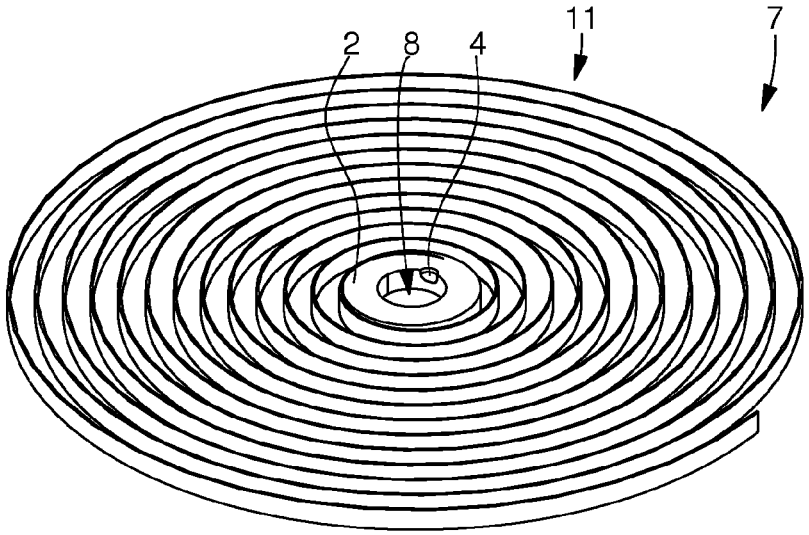
FIG. 2 is a diagram of a balance spring according to the invention.
Figure 3:
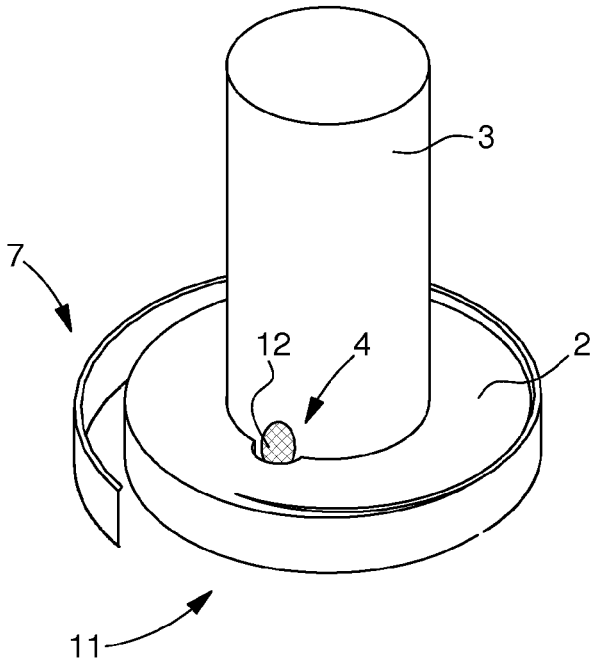
FIG. 3 is a partial diagram of FIG. 2.

FIG. 2 shows an enlarged view of balance spring 7 which, for the purposes of the explanation below, is a part made of material with no usable plastic domain, such as, for example, crystalline silicon, crystalline silica, crystalline alumina, silicon nitride or even silicon carbide. However, balance 5 can also be fabricated from this type of material and, consequently, can also be mounted on arbour 3 by means of a second securing system 9.

Preferably, balance spring 7 has a collet 2 which is integral therewith. This balance spring 7 may, for example, be obtained from a plate which is etched throughout, by photolithography of a photosensitive resin and then etching the parts of the plate that have no resin.

According to the invention, securing system 9 is for joining balance spring 7 to arbour 3. Thus, securing system 9 includes a securing device 11 that has a recess 4 and securing means 6. Recess 4, in the example of FIG. 2, communicates with the arbour hole 8 of collet 2. Recess 4 thus forms a slope 10 between the approximately vertical inner wall of arbour hole 8 and the approximately horizontal top surface of collet 2, as more clearly illustrated in FIG. 4. Slope 10 thus forms a blind recess, which has no edge, and which surrounds securing means 6. This slope 10 can thus be obtained from the teaching of CH Patent No. 1549/09 in the Applicant's name, which is incorporated herein by reference.

Securing means 6 are intended for attachment to arbour 3 and to at least partially match the shape of recess 4. Preferably, securing means 6 includes an insert made of metallic material which, according to three embodiments, can be obtained by partially melting arbour 3 or by melting a solder or by shrink fitting said metallic material in amorphous form.

Figure 5:
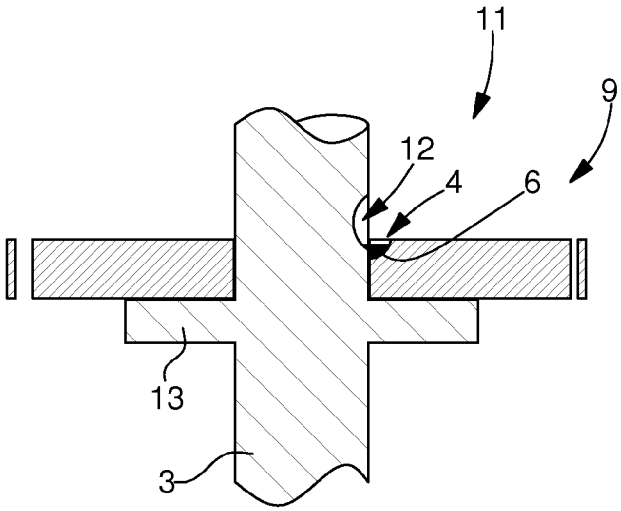
FIG. 5 is a similar diagram to FIG. 4 showing a securing device according to the invention.

Thus, as visible in FIG. 5, the hardening of the insert allows the preferably metallic arbour 3 to be attached but also forms a stud that cooperates with recess 4, which then acts like a mortise.

It is thus clear that securing means 6 do not have to be attached to collet 2 but only to arbour 3. However, the rotation movement of arbour 3, which imparts the same movement to securing means 6, also drives collet 2 mechanically, i.e. balance spring 7, via said stud—mortise connection. Consequently, advantageously according to the invention, balance spring 7 made of material with no usable plastic domain, is not stressed in its plastic domain.

Preferably, securing device 11 further includes a collar 13 mounted on arbour 3 to act as a shoulder for balance spring 7 in proximity to collet 2. Indeed, this configuration allows collet 2 to be locked relative to the length of arbour 3 via contact between collar 13, which forms a shoulder, and securing means 6, which form a stud.

The three embodiments of the fabrication method will now be explained. According to a first step a), the method starts with fabrication of part 7 with a hole 8 for receiving arbour 3 and a recess 4 that communicates with hole 8 as illustrated in FIG. 2.

According to a second step b) which may be carried out prior to, during or after step a), the method continues with fabrication of arbour 3 preferably with shoulder 13. In a third step c), the method continues with the assembly of arbour 3 in hole 8 of balance spring 7, preferably until it abuts against collar 13 of arbour 3.

The method then includes a fourth step d) for filling recess 4 with securing means 6 such as, for example, a metallic material so that it matches the shape of the recess and part of the external diameter of arbour 3. Finally, the method ends with a fifth and final step e) of hardening the metallic material so as to secure balance spring 7 to arbour 3.

Figure 4:
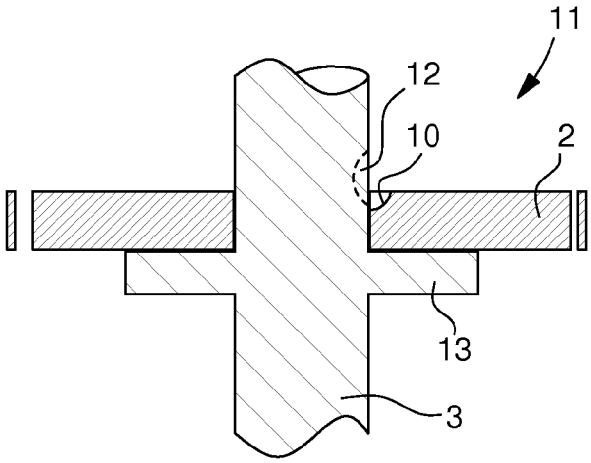
FIG. 4 is a cross-section of FIG. 3.

According to a first embodiment, step d) is achieved by localised melting of arbour 3, i.e. arbour 3 is partially melted at zone 12 so that one liquid part of arbour 3 runs into recess 4 as illustrated in FIGS. 4 and 5. The melting in step d) is, preferably, achieved by high energy radiation, for example, by means of a laser source.

According to a second embodiment, step d) is achieved by melting a solder, i.e. a metallic material between zone 12 and recess 4 is melted so that the solder is made liquid and runs into recess 4 in a similar manner to the first embodiment. The melting according to the second embodiment is also preferably achieved by high energy radiation, for example, by means of a laser source.

According to a third embodiment, step d) is achieved by shrink fitting said metallic material in amorphous form, i.e. the metallic material is heated to between its vitreous transition temperature and crystallisation temperature, then pressed into recess 4 so that it is moulded to the shape of said recess 4.

Thus, whichever embodiment is used, in the fifth and final step e), securing means 6 cool down and can be attached to arbour 3 to form said stud which will allow balance spring 7 to be driven in rotation via its collet 2. Thus, advantageously, even if the part, i.e. balance spring 7, is made of a material with no usable plastic domain, it is possible to secure it to an arbour 3 without having to drive in or bond said part.

Of course, the present invention is not limited to the illustrated example, but is capable of various variants and alterations which will be clear to those skilled in the art. In particular, slope 10 can be replaced by a vertical wall and a horizontal wall, i.e. recess 4 includes a bottom that is approximately parallel to the top surface of collet 2. In both examples, it is clear that recess 4 is blind, i.e. it does not pass right through the part which needs to be secured.

It is also clear that although the part in the above example is a balance spring 7, whose collet 2 includes hole 8 and recess 4, the invention can perfectly well be adapted to a wheel set type part whose hub includes the hole and recess or even to escapement pallets whose lever includes the hole and recess. As explained above, these examples concern the field of watchmaking. However, the invention can be applied to other fields.

What is claimed is:

1. A securing system comprising: a securing device arranged to secure a part made of a silicon-based material on an arbour, the arbour passing through a hole in the part, wherein the securing device has a blind recess, wherein the blind recess communicates with the hole in the part, and securing means attached to the arbour and at least partially matching the shape of the blind recess to make the movement of the part integral with that of the arbour without driving in or bonding the part.

2. The securing system according to claim 1, wherein a bottom of the blind recess is sloped so the bottom of the blind recess has no edge.

3. The securing system according to claim 1, wherein the securing means includes an insert made of metallic material.

4. The securing system according to claim 3, wherein the insert made of metallic material is in amorphous form.

5. The securing system according to claim 1, wherein the securing device further includes a collar mounted on the arbour to act as a shoulder for the part.

6. The securing system according to claim 1, wherein the silicon-based material comprises one of the group consisting of crystalline silicon, crystalline silica, silicon nitride and silicon carbide.

7. A timepiece wherein it includes a securing system according to claim 1.

8. A method of securing a part, made of a silicon-based material, onto an arbour, the method comprising the steps of:

a) fabricating the part made of silicon-based material with
   i) a hole for receiving the arbour; and
   ii) a blind recess communicating with the hole;
b) fabricating the arbour;
c) assembling the arbour in the hole of the part made of silicon-based material;
d) filling the blind recess with a metallic material so that it matches the shape of the blind recess and a part of an external diameter of the arbour;
e) hardening the metallic material so as to secure the part made of silicon-based material to the arbour without driving in or bonding.

9. The securing method according to claim 8, wherein step d) is achieved by locally melting the arbour.

10. The securing method according to claim 9, wherein the melting in step d) is achieved by means of high energy radiation.

11. The securing method according to claim 8, wherein step d) is achieved by melting a solder.

12. The securing method according to claim 8, wherein step d) is achieved by shrink fitting said metallic material in amorphous form.

13. The securing method according to claim 8, wherein a bottom of the blind recess is sloped so the bottom of the blind recess has no edge.

14. The securing method according to claim 8, wherein the silicon-based material comprises one of the group consisting of crystalline silicon, crystalline silica, silicon nitride and silicon carbide.

15. The securing method according to claim 8, wherein step c) continues until the part abuts against a collar of the arbour formed during step b).

16. A securing system comprising: a securing device arranged to secure a part made of a silicon-based material on an arbour, the arbour passing through a hole in the part, wherein the securing device has a blind recess, wherein the blind recess is arranged in the part made of silicon-based material and communicates with the hole in the part made of silicon-based material, and wherein the securing means attached to the arbour and at least partially matching the shape of the blind recess to make the movement of the part integral with that of the arbour without driving in or bonding the part.

* * * * *